US007342547B2

(12) United States Patent
Maniwa et al.

(10) Patent No.: US 7,342,547 B2
(45) Date of Patent: Mar. 11, 2008

(54) GLASS ANTENNA AND MANUFACTURING METHOD FOR THE SAME

(75) Inventors: Toru Maniwa, Kawasaki (JP); Andrey Andrenko, Kawasaki (JP); Shigekazu Kimura, Kawasaki (JP); Shigeru Hashimoto, Inagi (JP); Toshiaki Ibi, Inagi (JP); Akihide Sano, Tokyo (JP)

(73) Assignees: Fujitsu Limited, Kawasaki (JP); Fujitsu Frontech Limited, Inagi (JP); Nippon Sheet Glass Co., Ltd., Tokyo (JP)

( * ) Notice: Subject to any disclaimer, the term of this patent is extended or adjusted under 35 U.S.C. 154(b) by 16 days.

(21) Appl. No.: 11/342,669

(22) Filed: Jan. 31, 2006

(65) Prior Publication Data

US 2007/0057848 A1 Mar. 15, 2007

(30) Foreign Application Priority Data

Sep. 12, 2005 (JP) ..... 2005-263996

(51) Int. Cl.
*H01Q 1/32* (2006.01)

(52) U.S. Cl. ..... 343/713; 343/711

(58) Field of Classification Search ..... 343/713, 343/711, 700 MS, 846
See application file for complete search history.

(56) References Cited

U.S. PATENT DOCUMENTS

| | | | | |
|---|---|---|---|---|
| 3,818,489 | A | 6/1974 | Bobel, II et al. | |
| 4,633,262 | A | 12/1986 | Traut | |
| 6,198,447 | B1 | 3/2001 | Sauer | |
| 6,313,796 | B1 * | 11/2001 | Potin et al. | 343/700 MS |

FOREIGN PATENT DOCUMENTS

| | | |
|---|---|---|
| DE | 3834075 | 4/1989 |
| JP | 6-104551 | 4/1994 |
| JP | 6-247746 | 9/1994 |
| JP | 7-29916 | 6/1995 |
| JP | 10-341093 | 12/1998 |
| JP | 11127012 | 5/1999 |
| WO | WO 95/34921 A | 12/1995 |

* cited by examiner

*Primary Examiner*—Hoang V. Nguyen
(74) *Attorney, Agent, or Firm*—Bingham McCutchen LLP

(57) ABSTRACT

Either one or both of the antenna pattern and a ground pattern, which reflects a radiated radio wave radiated from the antenna pattern, are buried inside the glass substrate. As a result, it is possible to provide high-gain, low-loss glass antennas in which glass is used as their substrates.

17 Claims, 12 Drawing Sheets

110: WINDOW GLASS SHEET
120: ANTENNA CONDUCTOR
130: POWER SUPPLIER
150: INSULATION BOX
160, 170: LEG PORTION
180: COAXIAL CABLE
210: REFLECTION CONDUCTOR
220: HOLE

100: GLASS SHEET
200: INSIDE ANTENNA
300: OUTSIDE ANTENNA
400: HEAT-SHIELDING FILM
500: GLASS FOR VEHICLE

GLASS ANTENNA AND MANUFACTURING METHOD FOR THE SAME

CROSS REFERENCE TO RELATED APPLICATIONS

This application is based on and hereby claims priority to Japanese Application No. 2005-263996 filed on Sep. 12, 2005 in Japan, the contents of which are hereby incorporated by reference.

BACKGROUND OF THE INVENTION (1) Field of the Invention

The present invention relates to glass antennas formed on/in glass substrates and manufacturing methods for the same.

(2) Description of the Related Art

Recently, automobiles often have high-frequency GPS (Global Positioning System) antennas and also antennas for receiving satellite radio waves of satellite digital broadcasting. Further, there has been a demand for other types of antennas for use in ETC (Electronic Toll Collection) systems which automatically charge for use of highways or toll roads, and for radio wave beacons in the VICS (Vehicle Information Communication System). As such types of antennas, there has been technology in which window glass of automobiles is used as a substrate, and patch antennas (planner antennas) are constructed.

FIG. 11 is a side view showing a construction of a high-frequency glass antenna for automobiles given as a previous planner antenna. FIG. 11 corresponds to FIG. 5 of the following patent document 1. In the glass antenna of FIG. 11, an antenna conductor 120 is formed on the outer surface of the widow glass 110 of an automobile, and a reflection conductor 210 is formed on an inner surface of the window glass in such a manner that the antenna conductor 120 and the reflection conductor 210 at least partly face each other.

Here, for the purpose of good reception of GPS signals, which are circular polarization signals, the antenna conductor 120 has an antenna pattern of a spiral shape. The end of the center of the spiral form is connected to a power supplier 130. The size of the antenna pattern is 58 mm×46 mm, and the width of the line is 1 mm, and the interval between the spiral antenna conductor 120 is 5 mm.

The size of the reflection conductor 210 on the window glass 110 is 120 mm×60 mm. The reflection conductor 210 is electrically connected to the earth of a non-illustrated receiver through the following: a leg portion 170, which is formed by metal fittings for attaching an insulation box 150 to the window glass 110; a ground of an amplifier circuit built in the insulation box 150; and an outer conductor of a coaxial cable 180 for transmitting the output of the amplifier circuit to the non-illustrated receiver. Further, an electric supply line is connected from a power supplier 130, which is electrically connected to the input unit of the above amplifier circuit, to a part of the antenna conductor 120 with a conductive material through a hole 220 provided in the window glass 110.

With the above arrangement, in the present automobile high-frequency glass antenna, radio waves radiated from the antenna conductor 120 to the window glass 110 are reflected by the reflection conductor 210 and radiated to the antenna conductor 120 (outside of the automobile), so that antenna gain is increased.

Next, FIG. 12 is a schematic side view showing a construction of a previous window glass for automobiles as another previous planner antenna. FIG. 12 corresponds to FIG. 1 of the following patent document 2. The automobile window glass 500 of FIG. 12 is a glass sheet to be installed in an automobile, and on the surface of the glass substrate 100, a heat-shielding film 400 for shielding sunlight is applied. In a region in which the heat-shielding film 400 is not applied, the inside antenna 200 faces the outside antenna 300 with the glass substrate 100 interposed therebetween. With this arrangement, even in the automobile window glass to which the heat-shielding film 400 reflecting radio waves is applied, it becomes possible to transceive high-frequency radio waves such as FM waves or higher.

Further, the following patent document 3 discloses a technique for printing wiring on glass sheets. In the technique, a glass substrate is laid over a metal board which is appropriate as a conductor pattern material. From above the glass substrate, YAG laser light is emitted with a desired image pattern corresponding to a desired conductor pattern. As a result, the metal board is fused by heat or evaporated, and a desired conductor pattern is transferred to the glass substrate by heat. In this manner, a stable conductor pattern which does not come off easily is printed on the glass substrate, without using any chemicals. As an application of this technique, the following patent document 3 discloses the way of printing antenna conductor patterns on the windshields of automobiles for receiving FM broadcasting.

The following patent document 4 is not an art relating to antennas, but it discloses technology (electromagnetic wave-shielding film) for preventing the leakage and the invasion of electromagnetic waves. This electromagnetic wave-shielding film is a laminated film, on whose opposite sides, a metal conductive layer and a two-dimensional line pattern-printed layer are symmetrically laminated with the basic film as the center layer, or is a laminated film in which such films are laminated. All the patterns on the metal conductive layers and on the printed layers are substantially the same, and the patterns overlap one another on the basis film (the metal conductive layer is covered by the printed layer, viewed from the opposite sides of the basic film). This construction provides a film with good electromagnetic wave-shielding characteristics.

[Patent Document 1] Japanese Patent Application Laid-open No. HEI 7-29916

[Patent Document 2] Japanese Patent Application Laid-open No. HEI 6-247746

[Patent Document 3] Japanese Patent Application Laid-open No. HEI 6-104551

[Patent Document 4] Japanese Patent Application Laid-open No. HEI 10-341093

However, if antennas are simply formed on the surface of window glass as in the above patent documents 1 and 2, or using the technology disclosed in the above patent document 3, a problem of lowering of antenna gain because of loss due to the thickness of glass is caused. That is, normal glass sheets have a conductive loss of approximately 0.02, which is comparatively large. Thus, loss increases in frequencies of the UHF band or higher. If antenna (and ground patterns) are provided on the opposite sides of a glass sheet, gain is lowered because of loss of the glass sandwiched therebetween.

Further, when the technology disclosed in the above patent document 4 is applied to form a conductor pattern on a film, thereby providing an antenna, it is only possible to provide linear antenna. Hence, it is extremely difficult to provide high-gain antennas like patch antennas in which reflection boards are utilized.

SUMMARY OF THE INVENTION

With the foregoing problems in view, one object of the present invention is to provide high-gain, low-loss glass antennas which utilize glass substrates. Another object of the invention is to provide a method for manufacturing such antennas. In this instance, the applications of the invention are not limited to mobile objects such as vehicles, and the applications include entrance/exit gate systems and security systems.

In order to accomplish the above object, according to the present invention, the present invention is characterized in that the following glass antennas and their manufacturing method are provided.

(1) As a generic feature, there is provided a glass antenna, comprising: a glass substrate; an antenna pattern; and a ground pattern which reflects a radiated wave radiated from the antenna pattern, either or both of the antenna pattern and the ground pattern being buried inside the glass substrate.

(2) As a preferred feature, the antenna pattern is provided on one side of the glass substrate; and the ground pattern is buried inside the glass substrate.

(3) As another preferred feature, the glass substrate is a laminated glass sheet which is made of two glass sheets, a first glass sheet and a second glass sheet, stuck together with an adhesive layer interposed therebetween, and the antenna pattern is provided on a side opposite to an adhesion side of the first glass sheet, and wherein the ground pattern is provided on the adhesion side of the first glass sheet.

(4) As yet another preferred feature, the glass substrate is a laminated glass sheet which is made of two glass sheets, a first glass sheet and a second glass sheet, stuck together with an adhesive layer interposed therebetween, and the antenna pattern is provided on a side opposite to an adhesion side of the first glass sheet, and the ground pattern is provided on the adhesion side of the second glass sheet.

(5) As a further preferred feature, the ground pattern is provided on one side of the glass substrate, and the antenna pattern is buried inside the glass substrate.

(6) As a still further preferred feature, the glass substrate is a laminated glass sheet which is made of two glass sheets, a first glass sheet and a second glass sheet, stuck together with an adhesive layer interposed therebetween, and the ground pattern is provided on a side opposite to an adhesion side of the first glass sheet, and the antenna pattern is provided on the adhesion side of the first glass sheet.

(7) As an even further preferred feature, the antenna pattern and the ground pattern are buried inside the glass substrate oppositely to each other, the antenna pattern and the ground pattern being apart from each other so that a reflection distance with which the radiated radio wave is capable of being reflected is maintained.

(8) As another preferred feature, the glass substrate is a laminated glass sheet which is made of two glass sheet, a first glass sheet and a second glass sheet, stuck together with an adhesive layer therebetween, and the antenna pattern is provided on an adhesion side of the first glass sheet, and the ground pattern is provided on an adhesion side of the second glass sheet.

(9) As another generic feature, there is provided a glass antenna manufacturing method, comprising: forming an antenna pattern on one side of a first glass sheet, and forming a ground pattern on the other side of the first glass sheet, the ground pattern reflecting radiated radio waves of the antenna pattern; sticking one side of the first glass sheet or the other side of the first glass sheet and one side of a second glass sheet together with an adhesive layer interposed therebetween.

(10) As yet another generic feature, there is provided a glass antenna manufacturing method, comprising: forming an antenna pattern on one side of a first glass sheet, and forming a ground pattern on one side of a second glass sheet, the ground pattern reflecting radiated radio waves of the antenna pattern; sticking one side of the first glass sheet or the other side of the first glass sheet and one side of the second glass sheet together with an adhesive layer interposed therebetween.

According to the present invention, it is possible to construct high-gain antennas such as patch antennas in which a reflection board utilizing the thickness of glass is employed. Further, in comparison with antennas in which antenna patterns are arranged on the opposite sides of glass with the same thickness, it is possible to realize antennas lower in loss.

Further, since either of the antenna pattern and the ground pattern is buried inside the glass substrate, it is possible to protect the buried pattern.

Furthermore, when the antenna pattern and the ground pattern are formed on the opposite sides of a single sheet, those patterns can be accurately aligned, so that glass antennas with desired gain can be easily obtained.

Other objects and further features of the present invention will be apparent from the following detailed description when read in conjunction with the accompanying drawings.

DESCRIPTION OF THE PREFERRED EMBODIMENT(S)

[1] First Embodiment

For a design reason, antennas are often formed on glass.

Figure 1:
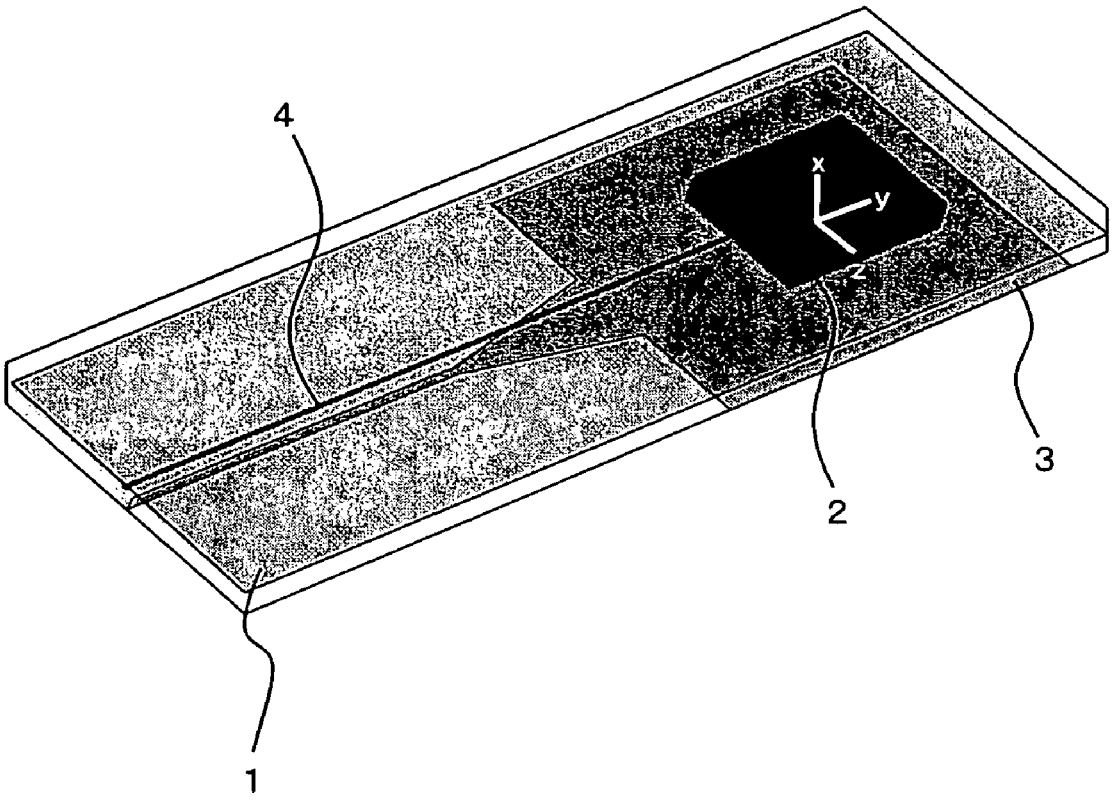
FIG. 1 is a schematic perspective view of a glass antenna (single patch antenna) according to a first embodiment of the present invention.
Figure 2:
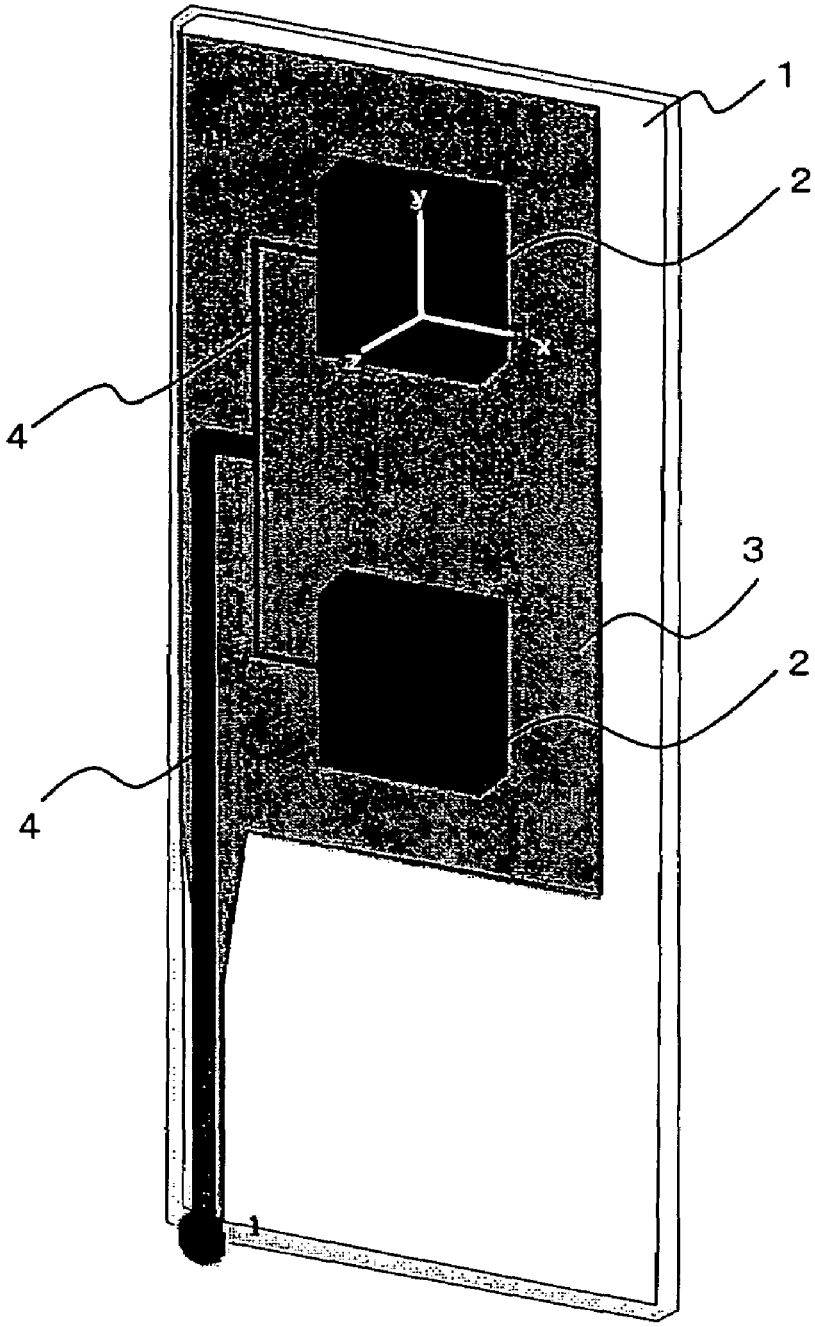
FIG. 2 is a schematic perspective view of a glass antenna (array patch antenna) according to a first embodiment of the present invention.

FIG. 1 and FIG. 2 are schematic perspective views of glass antennas according to a first embodiment of the present invention. The glass antenna of FIG. 1 is formed as a single patch antenna in which an antenna element [antenna pattern (conductor pattern)] 2 is formed on one side of the glass substrate 1. The glass antenna of FIG. 2 is formed as an array patch antenna in which more than one (here, two) antenna pattern 2 is formed on one side of the glass substrate 1.

Here, these glass antennas are usable both as transmitter antennas and as receiver antennas. Further, in FIG. 1 and FIG. 2, reference character 3 designates a ground pattern (conductor pattern) which is provided opposite to the antenna pattern 2, so as to function as a reflection board that reflects radio waves radiated from the antenna pattern 2 (or reflects received radio waves to the antenna pattern 2). Reference character 4 designates power supply lines (conductor pattern) to the antenna patterns 2. In this instance, in the present embodiment, the glass substrate 1 is given as a laminated glass in which two glass sheets are stuck together, and the ground pattern 3 is provided at a stick part between the two glass sheets.

Figure 3:
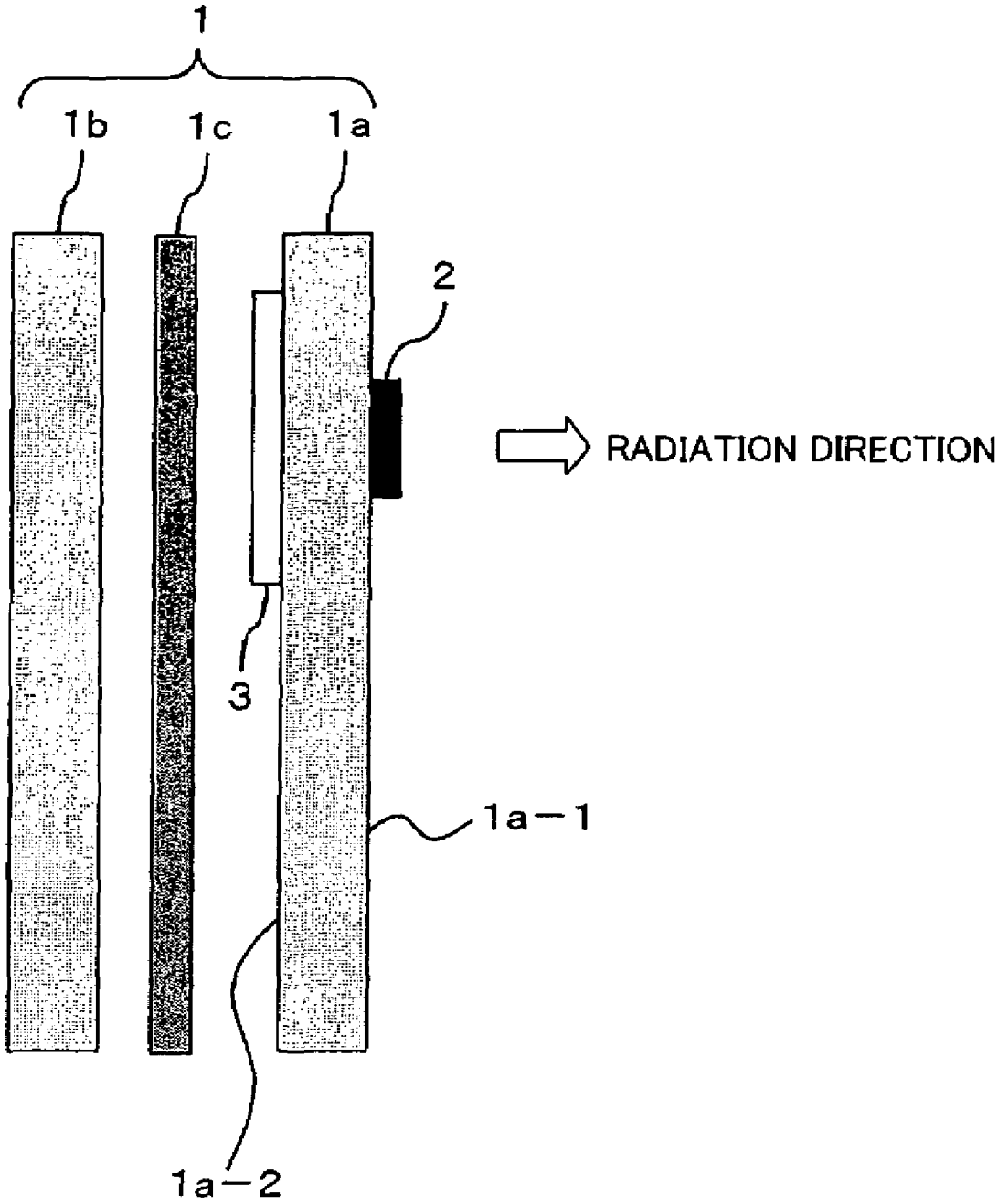
FIG. 3 is a schematic side view showing a construction of a glass antenna (single patch antenna) in an exploded manner according to a first embodiment of the present invention.

That is, a glass antenna (single patch antenna) of the present embodiment, as schematically shown in FIG. 3, for example, has two glass sheets 1*a* and 1*b*. An antenna pattern 2 is formed on one side (1*a*-1) of one (first) glass sheet 1*a*, and a ground pattern 3, which also functions as a reflection board that reflects radiated radio waves from the antenna pattern 2, at a position opposite to the antenna pattern 2. The side (1*a*-2) of this glass sheet 1*a* on which the ground pattern 3 is provided is stuck to one side of another (second) glass sheet 1*b* with an adhesive layer 1*c* which serves as an intermediated film interposed therebetween. With this arrangement, an antenna structure in which the antenna pattern 2 is provided on the surface 1*a*-2 of the glass substrate 1 and in which the ground pattern 3 is buried inside the glass substrate 1 at a position opposite to the antenna pattern 2, is realized. Hereafter, a description will be made on an assumption that the glass antenna is a single patch antenna, but the above-mentioned array patch antenna can also be provided by following the description hereinbelow with a difference in that two antenna patterns 2 must be prepared.

Here, the thickness of the whole glass substrate 1 is preferably approximately 10 mm. For example, the thickness of the glass sheets 1*a* and 1*b* is preferably approximately 5 mm, and the thickness of the intermediate film is preferably 0.76 mm. In this manner, since the glass has a thickness to some degree, it becomes possible to construct a patch antenna with a reflecting board 3 employed therein. The intermediate film (adhesive layer) 3 can be realized by an adhesive film made of e.g., polyvinyl butyral (the same applies in the following embodiments). Further, the antenna pattern 2 and the ground pattern 3 can be formed using a print technique such as silver printing.

A description will made hereinbelow of a manufacturing method for the above-described glass antenna. For example, as a first step, a print agent (silver paste or the like; the same applies in the following description) is applied over one side 1*a*-2 of the glass sheet 1*a* using a screen mesh for a ground pattern 3, and drying and firing is performed. Subsequently, as a second step, the print agent is applied over the other side 1*a*-1 of the same glass sheet 1*a* using a screen mesh for an antenna pattern 2, and drying and firing are performed. After that, as a third step, the ground pattern printed side 1*a*-2 of the glass sheet 1*a* and the glass sheet 1*b*, on which no printing is performed, are stuck together with an intermediate film 1*c* therebetween.

As a result, a glass antenna with the above-described construction is manufactured. Here, the first and the second steps can be performed in an inverse order, or the two steps can be carried out as one step utilizing a double-sided simultaneous printing process. This will reduce manufacturing time and costs.

In this manner, the glass substrate 1 is not given in the form of one glass sheet, but in the form of a laminated glass sheet in which two glass sheets 1*a* and 1*b*, half in thickness each, are stuck together, and on the opposite sides 1*a*-1 and 1*a*-2 of one of the two glass sheets, the antenna pattern 2 and the ground pattern 3, which are conductor patterns, are formed. In consequence, in comparison with a case where conductor patters are formed on opposite sides of a glass substrate made of one glass sheet with the same thickness (for example, approximately 10 mm), a glass portion between the antenna pattern 2 and the ground pattern 3 is reduced (that is dielectric loss is reduced). Therefore, a high-gain antenna like a patch antenna in which a reflection board 3 can be employed utilizing the thickness of the glass is realized with lower loss.

Further, since the present glass antenna has the ground pattern 3 buried inside the glass substrate 1, the ground 3 is protected. Furthermore, since the antenna pattern 2 and the ground pattern 3 are formed on the same glass sheet 1*a*, the positions of the antenna pattern 2 and the ground pattern 3 are accurately aligned. In consequence, a glass antenna with a desire gain is manufactured in an easy way.

Here, the thickness of the glass sheets 1*a* and 1*b* and the intermediate film 1*c* should not be limited to the above numerical example, and it can be varied as necessary. In addition, the glass sheet 1*a* and the glass sheet 1*b* can be the same or different in thickness. To reduce the dielectric loss induced by glass, the distance between the antenna pattern 2 and the ground pattern 3 is preferably as small as possible. Thus, it is preferable that the thickness of the glass sheet 1*a*, on which the antenna pattern 2 and the ground pattern 3 are formed, be as small as possible in a range in which necessary gain is assured.

In addition, in order to further reduce dielectric loss between the antenna pattern 2 and the ground pattern 3, thereby realizing low loss, the thickness of the portion of the glass sheet 1*a* sandwiched between the antenna pattern 2 and the ground pattern 3 is preferably made thin, or the portion is preferably removed and replaced with a material with lower loss than the glass sheet 1*a* such as ceramic, plastic, and crystal glass (or just removed and left as it is).

Further, the positions at which the antenna pattern 2 and ground pattern 3 are formed should not be limited to the positions illustrated in FIG. 1 and FIG. 3, and they can be varied as necessary (the same applies in the following description).

[2] Second Embodiment

Figure 4:
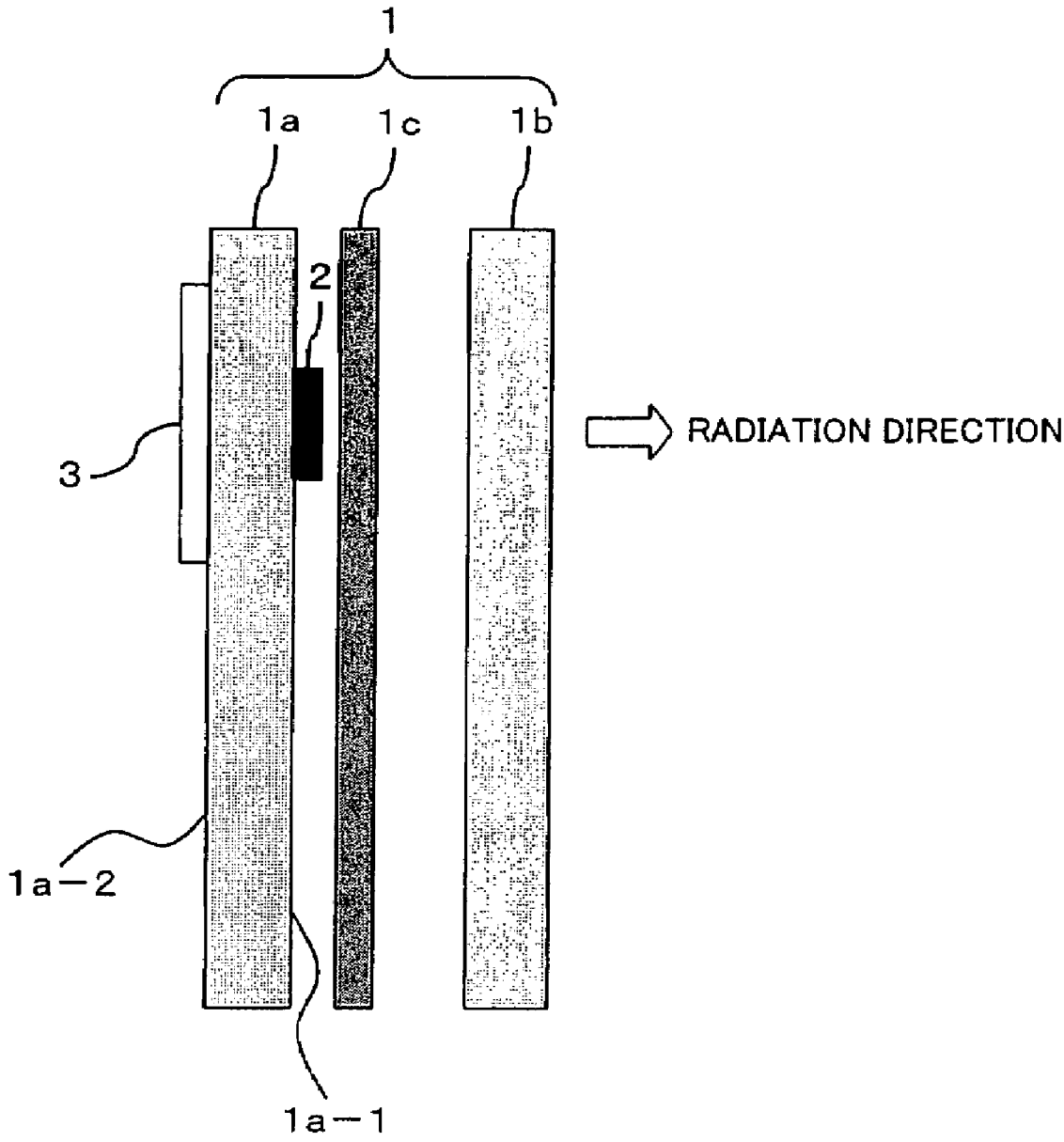
FIG. 4 is a schematic side view showing a construction of a glass antenna in an exploded manner according to a second embodiment of the present invention.

FIG. 4 is a schematic side view showing a construction of a glass antenna in an exploded manner according to a second embodiment of the present invention. The glass antenna of FIG. 4 differs from the glass antenna of FIG. 3 in that in the glass substrate 1, the glass sheet 1*b* is stuck to the side on which the antenna pattern 2 is formed, with an adhesive layer 1*c* which functions as an intermediate film interposed therebetween. That is, in this embodiment, the antenna pattern 2, not the ground pattern 3, is buried inside the glass substrate 1. Here, in FIG. 4, elements designated by the already described reference characters are the same as or similar to the elements already described, unless otherwise described.

Now, a description will be made of a manufacturing method for a glass antenna of the present embodiment. For example, as a first step, a print agent is applied over one side 1*a*-2 of the glass sheet 1*a* using a screen mesh for a ground pattern 3, and drying and firing are performed. Subsequently, as a second step, a print agent is applied over the other side 1*a*-1 of the glass sheet 1*a* utilizing a screen mesh for an antenna pattern 2, and drying and firing are performed. Then, as a third step, the antenna pattern-printed side 1*a*-1 of the glass board 1*a* and a glass sheet 1*b*, on which no printing is performed, are stuck together with an intermediate film 1*c* interposed therebetween.

These steps make it possible to manufacture a glass antenna with the above-described construction. In the present embodiment, also, the first and the second steps are changeable in order, or they can be concurrently performed as a single step by using a double-sided simultaneous printing process.

With this arrangement, a radiation electric field is concentrated in the radiation direction (the direction which vertically extends from the antenna pattern 2-formed side 1*a*-1) of the antenna pattern 2. That is, in the present embodiment, the antenna pattern 2 is buried inside the glass substrate 1 with comparatively large (approximately 7) relative permittivity. In comparison with a glass antenna having the construction already described with reference to FIG. 3, the dielectric loss is slightly enlarged, but the directivity of radiated radio waves are a little improved. In addition, since the antenna pattern 2 is buried in the glass substrate 1, it is possible to protect the antenna pattern 2.

[3] Third Embodiment

Figure 5:
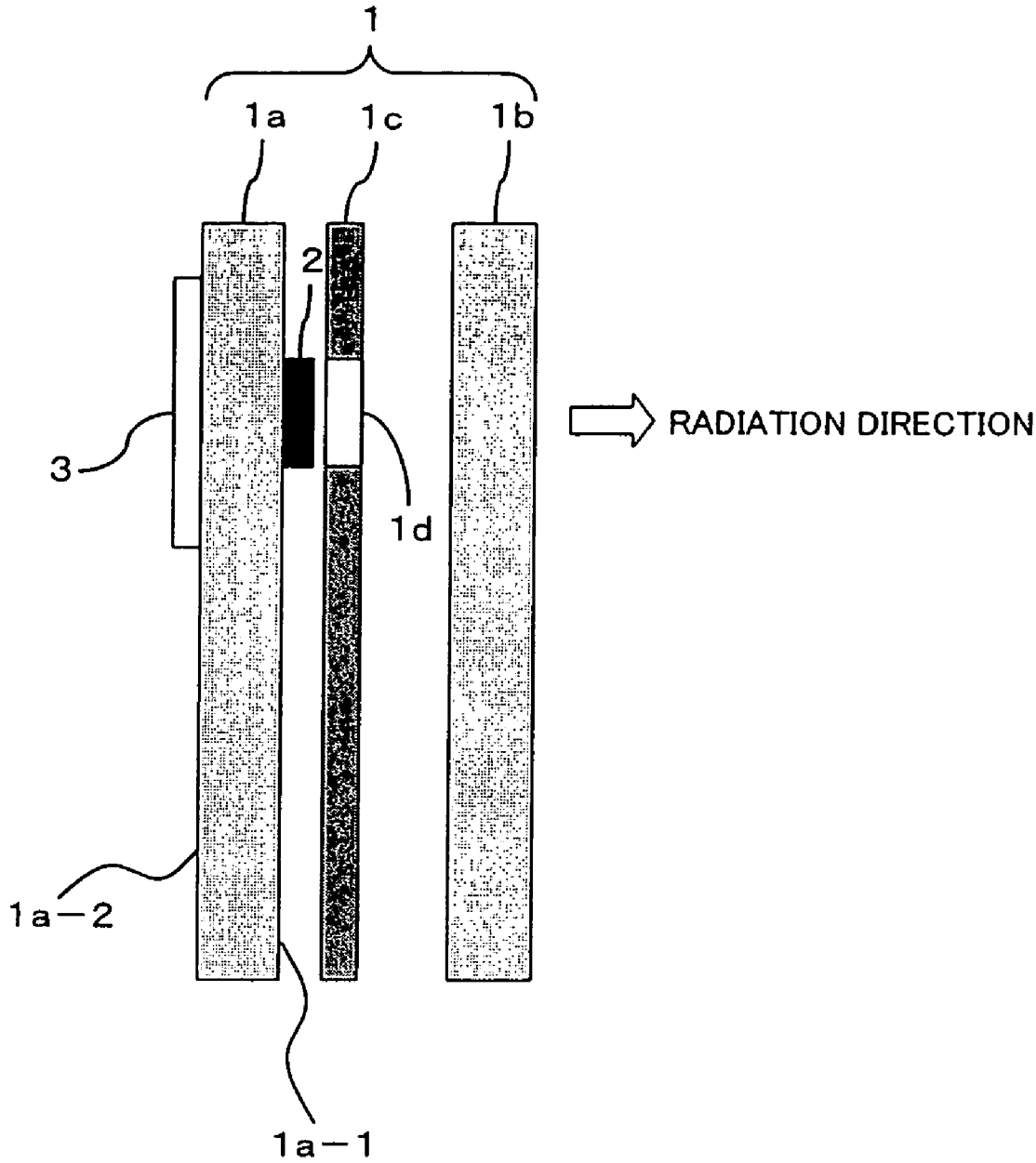
FIG. 5 is a schematic side view showing a construction of a glass antenna in an exploded manner according to a third embodiment of the present invention.

FIG. 5 is a schematic side view showing a construction of a glass antenna in an exploded manner according to a third embodiment of the present invention. The glass antenna of FIG. 5 takes the antenna construction already described with reference to FIG. 4 as a base, and a portion of the intermediate film 1*c* at which the antenna pattern 2 exists is removed, and the portion is replaced with a low loss material 1*d* such as ceramic, polypropylene, or plastic, etc. Here, in FIG. 5, also, elements designated by the already described reference characters are the same as or similar to the elements already described, unless otherwise described.

Here, a description will be made of a manufacturing method for a glass antenna of the present embodiment. For example, as a first step, a print agent is applied over one side 1*a*-2 of the glass sheet 1*a* using a screen mesh for a ground pattern 3, and drying and firing are performed. Subsequently, as a second step, a print agent is applied over the other side 1*a*-1 of the glass sheet 1*a* utilizing a screen mesh for an antenna pattern 2, and drying and firing are performed. Then, as a third step, a contact portion of the intermediate film 1*c* (to which the glass sheets 1*a* and 1*b* are stuck), which portion contacts the antenna pattern 2, is removed in accordance with the shape of the antenna pattern 2, and the portion is filled with a low loss material 1*d*. Then, as a fourth step, the antenna pattern-printed side 1*a*-1 of the glass board 1*a* and a glass sheet 1*b*, on which no printing is performed, are stuck together with an intermediate film 1*c*, in which the low loss material 1*d* is filled, interposed therebetween.

As a result, the glass antenna with a construction illustrated in FIG. 5 is manufactured. Here, the order of the above first through third steps is exchangeable. Further, the above first and second steps can be performed as a single step utilizing double-sided simultaneous printing process.

The antenna structure of the present embodiment further reduces dielectric loss in the radiation direction of the antenna pattern 2, so that a glass antenna with lower loss than that of the second embodiment is realized. In this instance, in the present embodiment, a portion of the intermediate film 1*c* (the portion corresponding to the antenna pattern 2) is removed. However, it is not always necessary to remove the portion, and the portion is made thinner than its surrounding portions and the thinned part is filled with the above low loss material 1*d*. This method is also effective in reducing gain loss.

Figure 6:
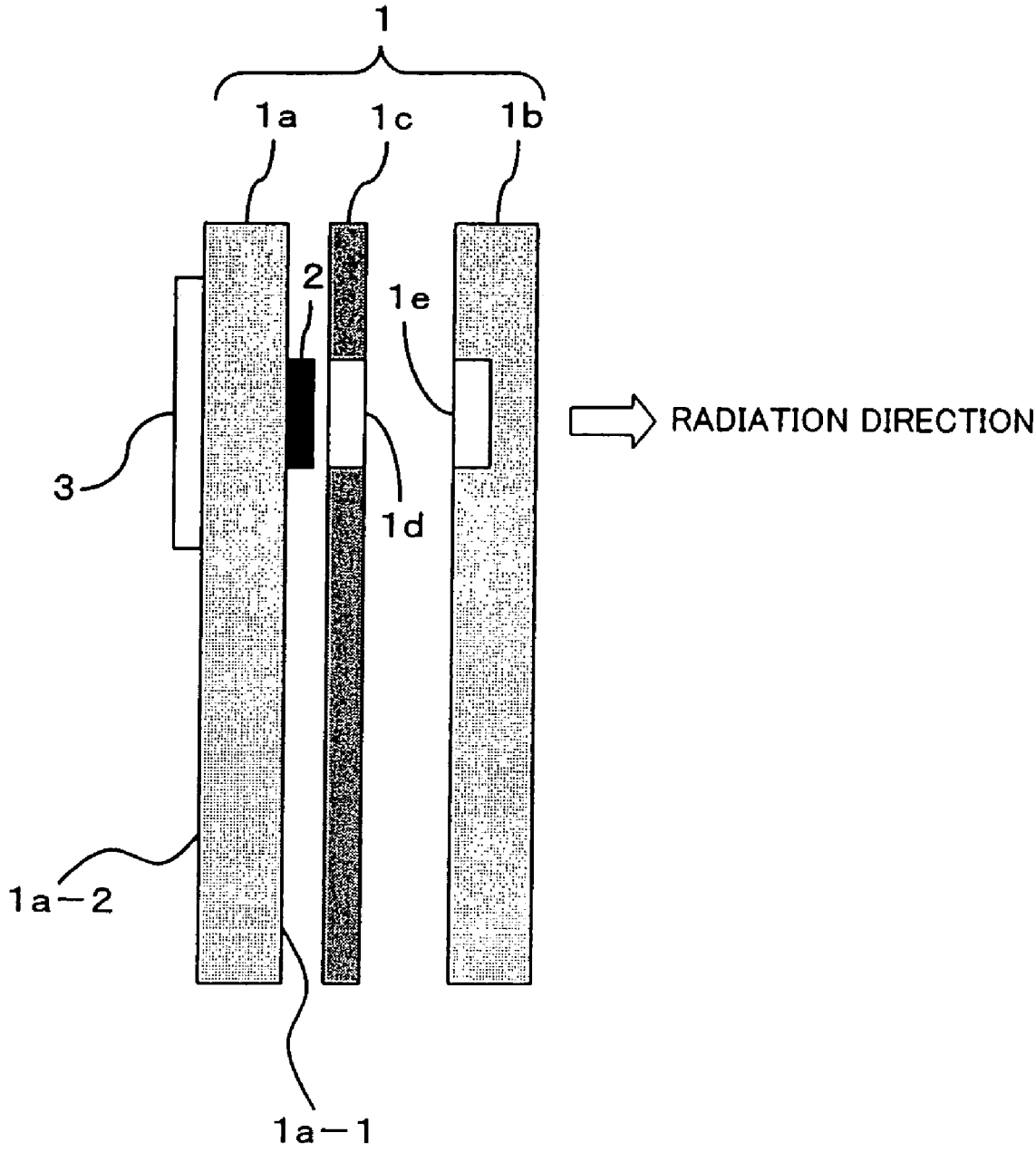
FIG. 6 is a schematic side view showing a construction of a glass antenna in an exploded manner according to a modified example of the third embodiment of the present invention.

Further, as shown in FIG. 6, a portion of not only the intermediate film 1*c* but also of the glass sheet 1*b*, which portion is opposite to the antenna pattern 2, is made thinner than their surrounding portions (or removed) and the portions are filled with a low loss material 1*e* having dielectric loss lower than that of the glass sheet 1*b* such as ceramic, plastic, and crystal glass. As a result, further lowering of loss of gain is realized. In this instance, as shown in FIG. 6, such a low loss material 1*e* can be used only in the glass sheet 1*b*. In addition, as to any of the antenna structures of FIG. 5 and FIG. 6, the removed portion or the thinner portion can be left as they were, not being filled with the low loss material 1*d* or low loss material 1*e*.

[4] Fourth embodiment

Figure 7:
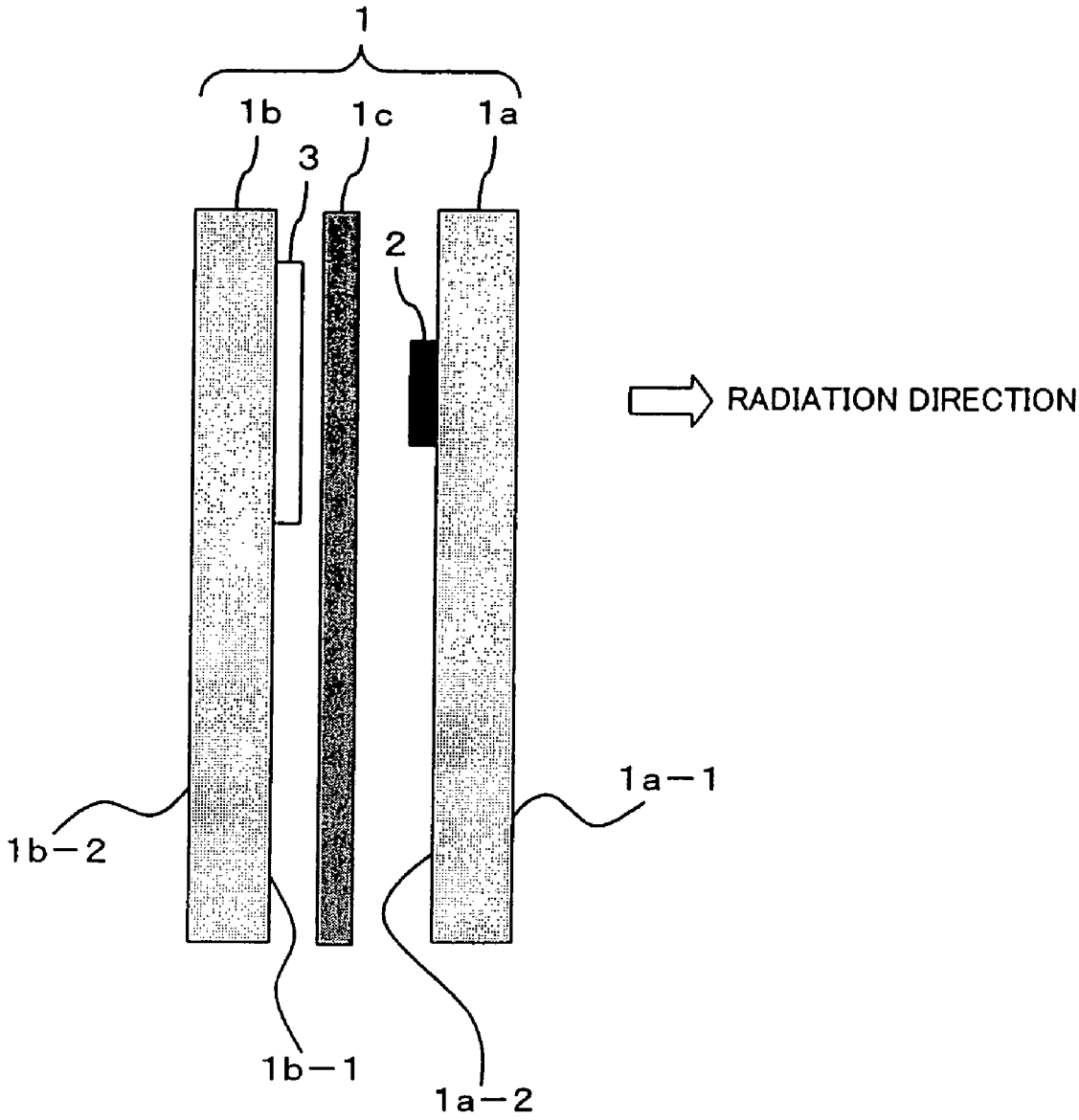
FIG. 7 is a schematic side view showing a construction of a glass antenna in an exploded manner according to a fourth embodiment of the present invention.

FIG. 7 is a schematic side view showing a construction of a glass antenna in an exploded manner according to a fourth embodiment of the present invention. The glass antenna of FIG. 7 has two glass sheets 1*a* and 1*b*, and on one side 1*a*-2 of the opposite sides 1*a*-1 and 1*a*-2 of the glass sheet 1*a*, an antenna pattern (conductor pattern) 2 is formed. In addition, on one side 1*b*-1 of the opposite sides 1*b*-1 and 1*b*-2 of the other glass sheet 1*b*, a ground pattern (conductor pattern) 3, which functions as a reflection board, is formed at a position opposite the antenna pattern 2 when the glass sheets 1*a* and 1*b* are combined into the glass substrate 1. These glass sheets 1*a* and 1*b* are stuck together with the intermediate film (adhesive layer) 1*c* interposed therebetween in such a manner that the conductor patterns 2 and 3 are stuck together with the intermediate film (adhesive layer) 1*c* interposed therebetween. As a result, the glass antenna of the present embodiment has such a structure in which the antenna pattern 2 and the ground pattern 3 are buried inside the glass substrate 1 at a position at which the two conductors are opposite each other. In this instance, in FIG. 7, also, elements designated by the already described reference characters are the same as or similar to the elements already described, unless otherwise described.

In this embodiment, the glass sheets 1*a* and 1*b* are preferably half as thick (5 mm) as the glass substrate 1. However, as to the thickness of the intermediate film (adhesive layer) 1*c*, it needs to have a thickness (for example, 2 mm or 3 mm) to assure the distance adequate for the ground pattern 3 to function as a reflection board. In this case, the intermediate film 1*c* can be formed by laminating the necessary number of adhesive films (normally, one film has a thickness of approximately 0.76 mm). Further, in the present embodiment, also, the antenna pattern 2 and the ground pattern 3 can be formed by a printing technique such as silver printing.

Now, a description will be made of a manufacturing method for a glass antenna of the present embodiment. For example, as a first step, a print agent is applied over one side 1*a*-2 of the glass sheet 1*a* using a screen mesh for a ground pattern 3, and drying and firing are performed. Subsequently, as a second step, a print agent is applied over the other side 1*a*-1 of the glass sheet 1*a* utilizing a screen mesh for an antenna pattern 2, and drying and firing are performed. Then, as a third step, a contact portion of the intermediate film 1*c* (to which the glass sheets 1*a* and 1*b* are stuck), which portion contacts the antenna pattern 2, is removed in accordance with the shape of the antenna pattern 2, and the portion is filled with a low loss material 1*d*.

Next, as a fourth step, a part (or the whole) of the glass sheet 1*b* at a position corresponding to the antenna pattern 2 is removed, and a low loss material 1*e* is filled therein. Then, as a fifth step, the side of the glass sheet 1*b* on which a low loss material 1*e* is buried and the antenna pattern printed side 1*a*-1 is stuck together with an intermediate film 3, in which a low loss material 1*d* is buried, interposed therebetween.

In this manner, the glass antenna with a construction of FIG. 6 is manufactured. In this embodiment, also, the first to the fourth steps are exchangeable in order, and the first step and the second step can be carried out as a single step utilizing a double-sided simultaneous printing process.

With this arrangement, only the intermediate film 1*c*, which is thinner than the glass sheets 1*a* and 1*b*, exists between the antenna pattern 2 and the ground pattern 3. Thus, in comparison with the already described construction, the distance between the antenna pattern 2 and the ground pattern 3 is small, so that the reflection effect by the ground pattern 3 is improved, and gain is also improved.

In the present example, like in the antenna construction already described in the second embodiment, the antenna pattern 2 is formed on the side 1*a*-2 which comes into contact with the intermediate film 3, and is buried inside the glass substrate 1, so that a radiation field is concentrated in the radiation direction of the antenna pattern 2 (the direction extending vertically from the side 1*a*-1 which is opposite the side 1*a*-2 on which the antenna pattern 2 is formed). That is, in this case, also, since the antenna pattern 2 is buried inside the glass substrate 1 having comparatively large relative permittivity (approximately 7), dielectric loss is slightly increased but the directivity of radiated radio waves is a little improved.

Further, since both the antenna pattern 2 and the ground pattern 3, both of which are conductor patterns, are buried inside the glass substrate 1, it is possible to protect both of the conductor patterns 2 and 3.

Figure 8:
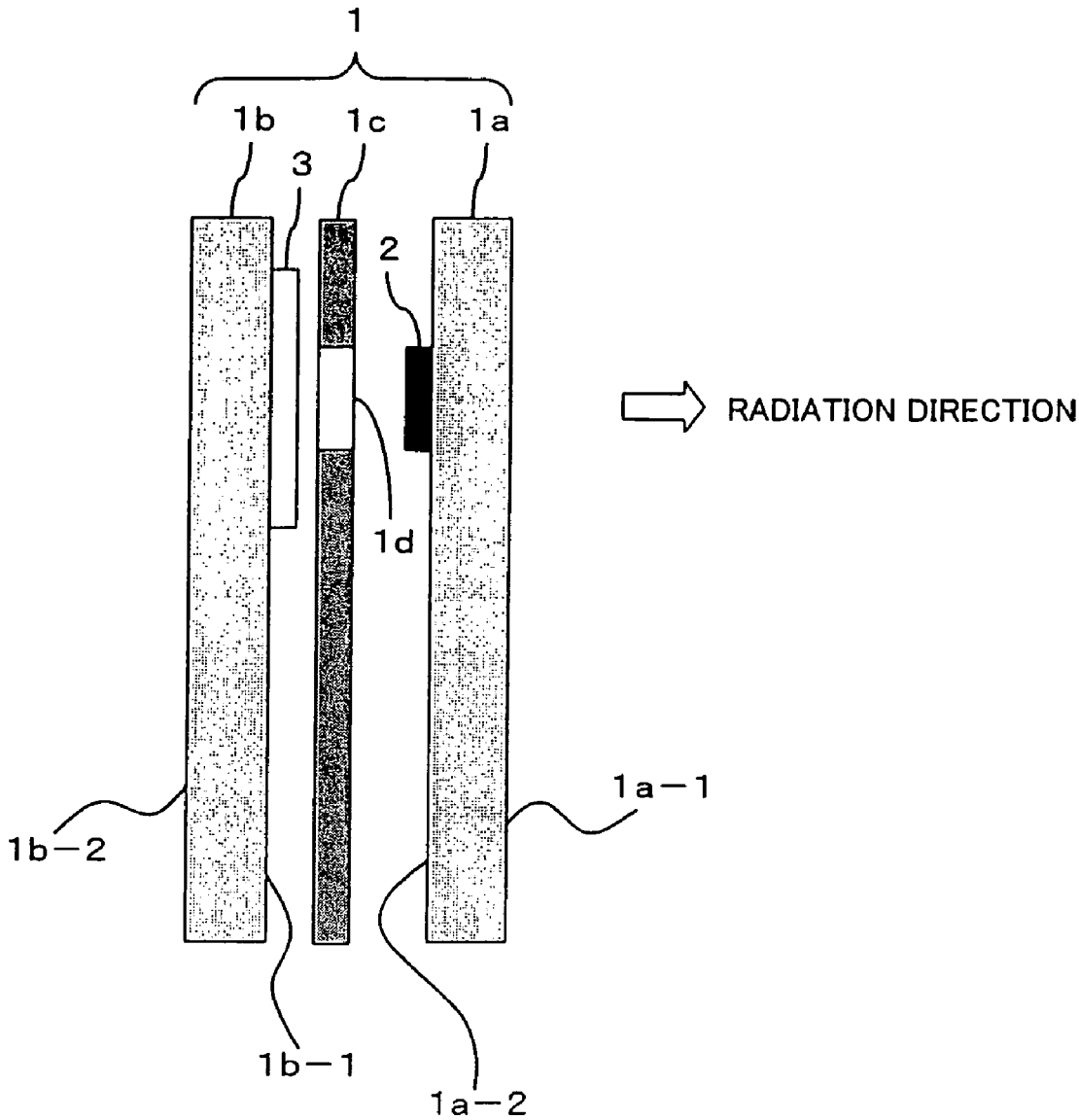
FIG. 8 is a schematic view showing a construction of a glass antenna in an exploded manner according to a first modified example of the fourth embodiment of the present invention.
Figure 9:
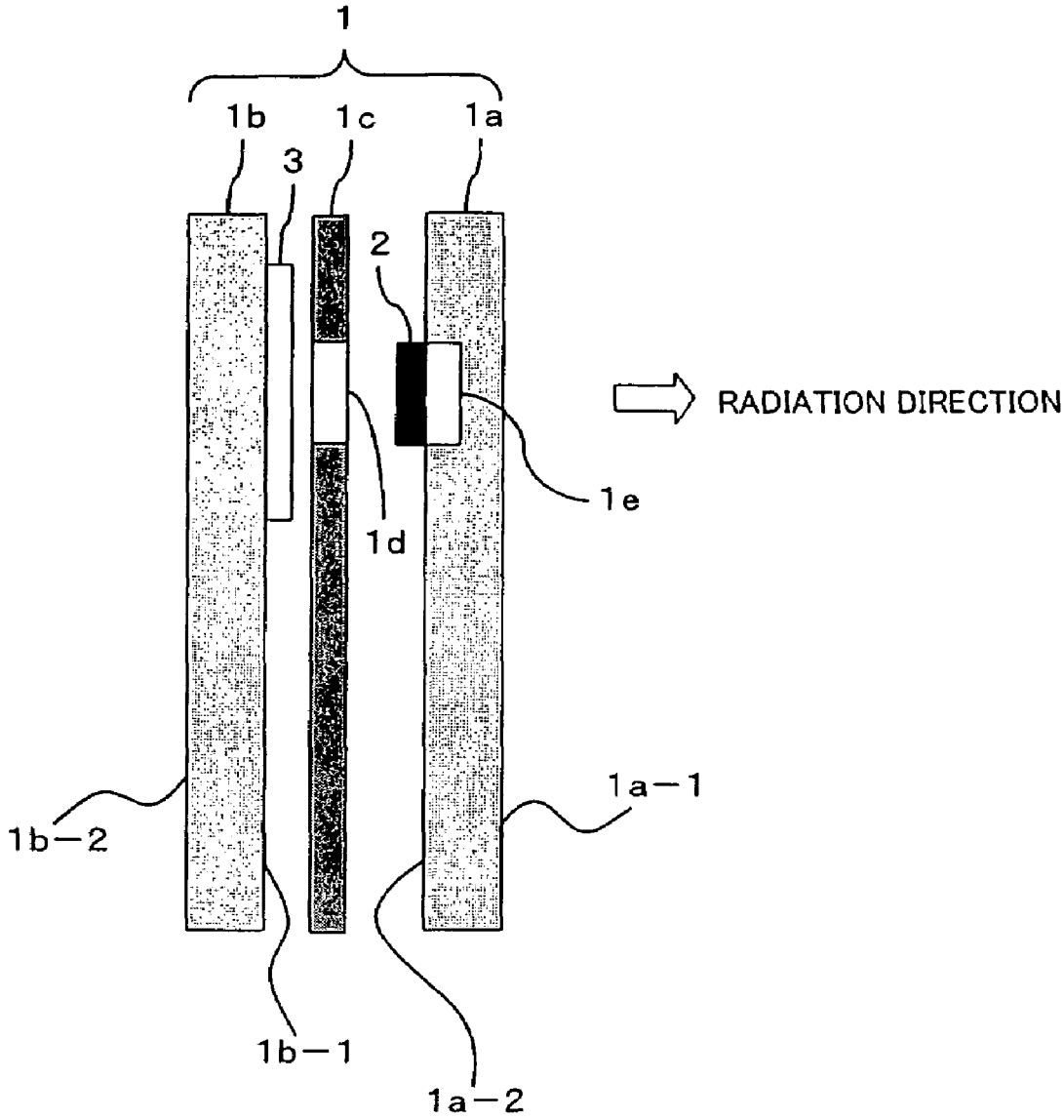
FIG. 9 is a schematic view showing a construction of a glass antenna in an exploded manner according to a second modified example of the fourth embodiment of the present invention.

In this instance, as in the case of the antenna construction already described with reference to FIG. 5, as shown in FIG. 8, if a portion of the intermediate film 1*c*, which portion is opposite to the antenna pattern 2, is removed (or thinned), and is replaced with a low loss material 1*d*, such as ceramic, polypropylene, and plastic, with small dielectric loss, the loss is further reduced. Further, like the antenna construction already described with reference to FIG. 6, as shown in FIG. 9, if a portion of not only the intermediate film 1*c* but also of the glass sheet 1*a*, which portion is opposite to the antenna pattern 2, is made thinner than the surrounding portion (or removed), and the portion is replaced with a low loss material 1*e* whose loss is smaller than the dielectric loss of the glass sheet 1*a*, such as ceramic, plastic, and crystal glass, further reduction in loss is realized.

Here, in the present embodiment, also, the low loss material 1*e* can be used only in the glass sheet 1*a*. Further, in the antenna constructions of FIG. 8 and FIG. 9, the removed or thinned portion is left as it is, without being replaced with the low loss material 1*d* or 1*e*.

[5] Fifth Embodiment

Figure 10:
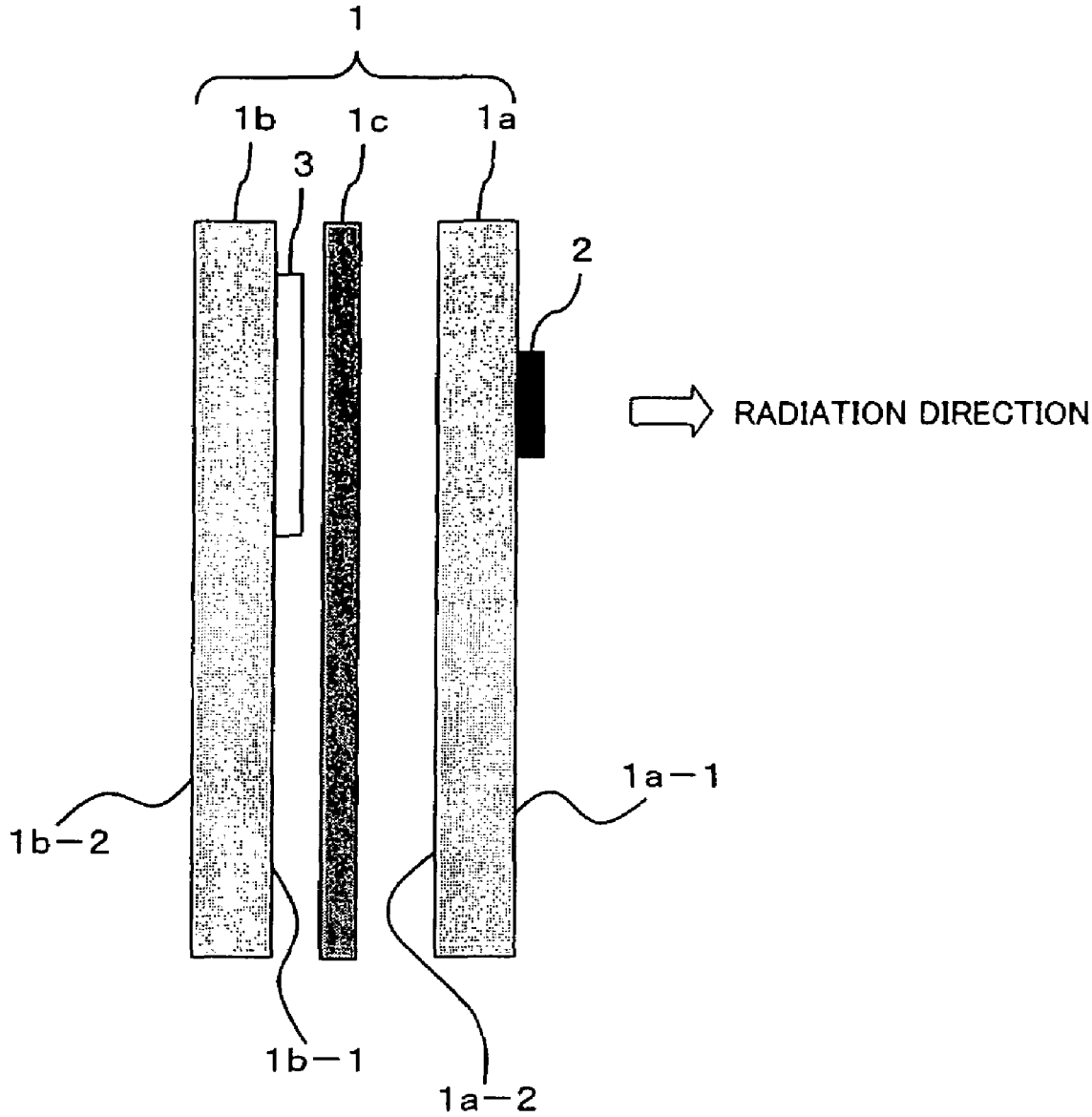
FIG. 10 is a schematic side view showing a construction of a glass antenna in an exploded manner according to a fifth embodiment of the present invention.
Figure 11:
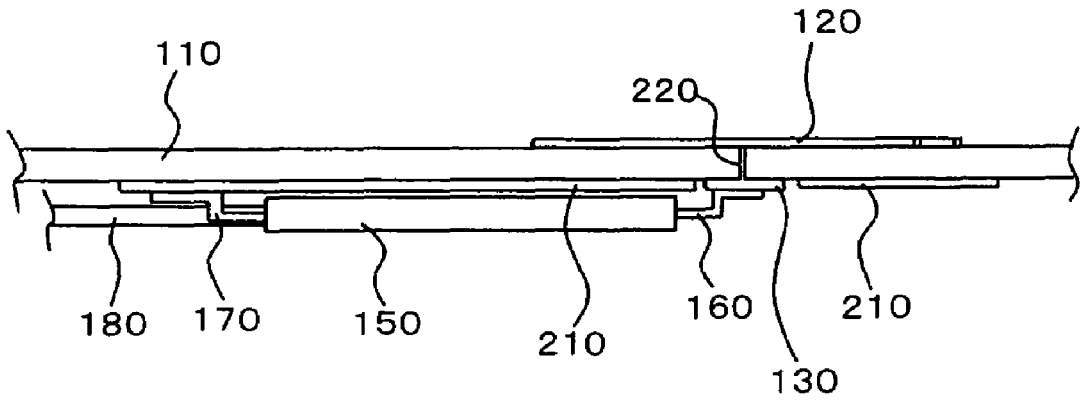
FIG. 11 PRIOR ART
FIG. 11 is a side view showing a construction of a high-frequency glass antenna for automobiles given as a previous planner antenna.
Figure 12:
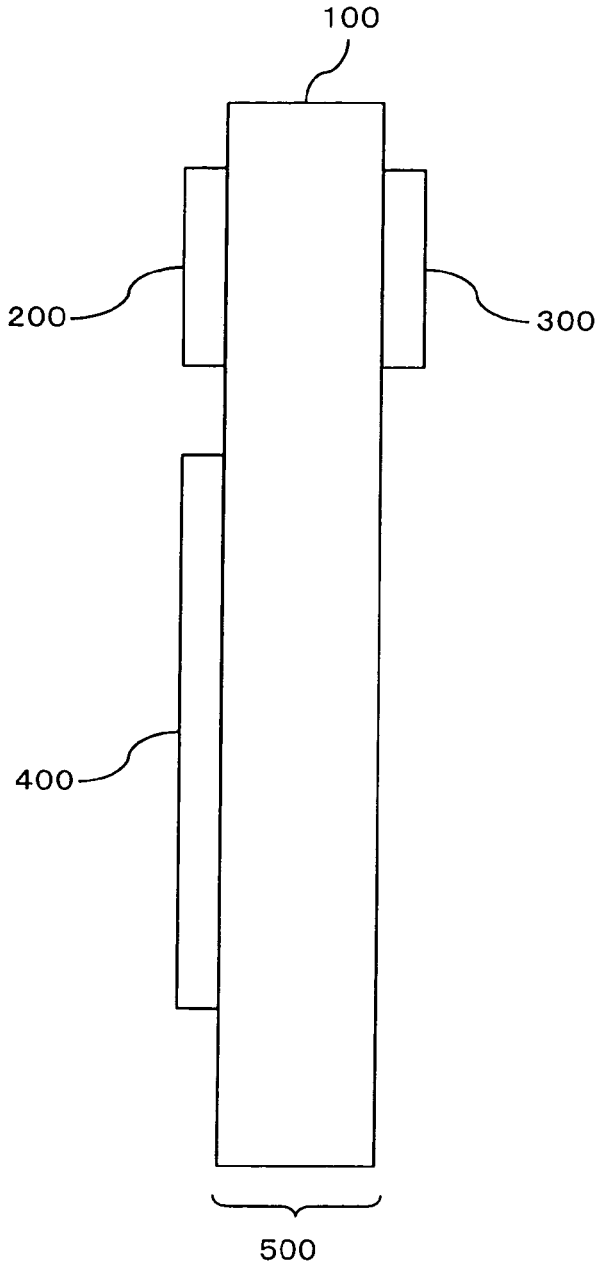
FIG. 12 PRIOR ART
FIG. 12 is a schematic side view showing a construction of a previous window glass for automobiles as another previous planner antenna.

FIG. 10 is a schematic side view showing a construction of a glass antenna in an exploded manner according to a fifth embodiment of the present invention. The glass antenna of FIG. 10 has two glass sheets 1*a* and 1*b*. On one side 1*a*-1 of the opposite sides 1*a*-1 and 1*a*-2 of one glass sheet 1*a*, an antenna pattern (conductor pattern) 2 is formed. On one side 1*b*-1 of the opposite sides 1*b*-1 and 1*b*-2 of the other glass sheet 1*b*, a ground pattern (conductor pattern) 3 which functions as a reflection board is provided at a position which corresponds to the reverse side of the antenna pattern 2 when the glass sheets 1*a* and 1*b* are stuck together. The glass sheets 1*a* and 1*b* are stuck together so that the sides 1*a*-2 and 1*b*-1 are opposite each other. As a result, the antenna pattern 2 is formed on the surface 1*a*-1 of the glass substrate 1 and the ground pattern 3 is buried inside the glass substrate 1.

That is, the antenna construction of FIG. 10 is another version of the antenna construction of the first embodiment already described with reference to FIG. 1. In FIG. 10, the ground pattern 3, which was formed on one side 1*a*-2 (the side which comes into contact with the intermediate film 1*c*) of the glass sheet 1*a* in the first embodiment, is formed on the side 1*b*-1 of the glass sheet 1*b* which comes into contact with the intermediate film 1*c*. In FIG. 10, also, elements designated by the already described reference characters are the same as or similar to the elements already described, unless otherwise described.

Here, in the present embodiment, as in the case of the first embodiment, the thickness of the glass substrate 1 should preferably be approximately 10 mm. Since the distance between the antenna pattern 2 and the ground pattern 3 is preferably as small as possible, the thickness of the glass sheet 1*a* should be thinner than the thickness of the glass sheet 1*b*, on which the ground pattern 3 is formed. In the present embodiment, the intermediate film (adhesive layer) 1*c* is realized by an adhesive film such as polyvinyl butyral. The antenna pattern 2 and ground pattern 3 are formed by print technology such as silver printing.

A description will be made hereinbelow of a manufacturing method for a glass antenna of the present embodiment. For example, as a first step, a print agent is applied over one side 1*a*-1 of the glass sheet 1*a* using a screen mesh for an antenna pattern 2, and drying and firing are performed. Subsequently, as a second step, a print agent is applied over the other side 1*b*-1 of the glass sheet 1*b* utilizing a screen mesh for a ground pattern 3, and drying and firing are performed. Then, as a third step, the side 1*a*-2 of the glass sheet 1*a* on which no antenna pattern is printed and the ground pattern-printed side 1*b*-1 of the glass sheet 1*b* are stuck together with a intermediate film 1*c* interposed therebetween.

With these steps, a glass antenna with the above-described construction can be manufactured. In the present embodiment, also, the first and the second steps can be exchanged in order, or these steps can be carried out as a single step by using a double-sided simultaneous printing process. According to the present embodiment, as in the case of the first embodiment, in comparison with a case where the conductor patterns are formed on opposite sides of one glass sheet (with a thickness of, e.g, approximately 10 mm), the thickness of the glass between the antenna pattern 2 and the ground pattern 3 is reduced (that is, dielectric loss is reduced). Thus, high-gain antennas such as patch antennas in which reflection boards are usable, utilizing the thickness of the glass can be realized with lower loss than ever. In addition, since the ground pattern 3 is buried inside the glass substrate 1, it is possible to protect the ground pattern 3.

Here, in the present embodiment, also, in order to further reduce the dielectric loss between the antenna pattern 2 and the ground pattern 3, thereby realizing lower loss, the thickness of the portion of the glass sheet 1*a* and of the intermediate film 1*c* sandwiched between the antenna pattern 2 and the ground pattern 3 can be made thinner or the portion can be removed. The portion is preferably replaced with a low loss material such as ceramic, plastic, and crystal glass (or is left as it is).

Further, the present invention should by no means be limited to the above-illustrated embodiment, but various changes or modifications may be suggested without departing from the gist of the invention.

As described so far, according to the present invention, it is possible to provide higher-gain and lower-loss antennas formed on glass substrates, in comparison with previous antennas formed on glass substrates. Thus, the present invention is considered to be significantly useful when employed in technology fields in which radio waves are used, such as automobile GPS antennas, entrance/exit gate systems, and security systems.

What is claimed is:

1. A glass antenna, comprising:

a glass substrate;

an antenna pattern; and a ground pattern which reflects a radiated wave radiated from said antenna pattern, wherein said antenna pattern is provided on one side of said glass substrate; and wherein said ground pattern is buried inside said glass substrate.

2. A glass antenna as set forth in claim 1, wherein said glass substrate is a laminated glass sheet which is made of two glass sheets, a first glass sheet and a second glass sheet, stuck together with an adhesive layer interposed therebetween, wherein said antenna pattern is provided on a side opposite to an adhesion side of the first glass sheet, and wherein said ground pattern is provided on the adhesion side of the first glass sheet.

3. A glass antenna as set forth in claim 2, wherein a part or the whole of at least a portion of said adhesive layer, which portion is opposite to said antenna pattern, is made of a material with dielectric loss lower than that of said adhesive layer.

4. A glass antenna as set forth in claim 2, wherein a part or the whole of at least a portion of said glass sheets, which portion is opposite to said antenna pattern, is made of a material with dielectric loss lower than that of said glass sheet.

5. A glass antenna as set forth in claim 1, wherein said glass substrate is a laminated glass sheet which is made of two glass sheets, a first glass sheet and a second glass sheet, stuck together with an adhesive layer interposed therebetween, wherein said antenna pattern is provided on a side opposite to an adhesion side of the first glass sheet, and wherein said ground pattern is provided on the adhesion side of the second glass sheet.

6. A glass antenna as set forth in claim 5, wherein a part or the whole of at least a portion of said adhesive layer, which portion is opposite to said antenna pattern, is made of a material with dielectric loss lower than that of said adhesive layer.

7. A glass antenna as set forth in claim 5, wherein a part or the whole of at least a portion of said glass sheets, which portion is opposite to said antenna pattern, is made of a material with dielectric loss lower than that of said glass sheet.

8. A glass antenna, comprising:

a glass substrate;

an antenna pattern; and a ground pattern which reflects a radiated wave radiated from said antenna pattern, wherein said ground pattern is provided on one side of said glass substrate, wherein said antenna pattern is buried inside said glass substrate, wherein said glass substrate is a laminated glass sheet which is made of two glass sheets, a first glass sheet and a second glass sheet, stuck together with an adhesive layer interposed therebetween, wherein said ground pattern is provided on a side opposite to an adhesion side of the first glass sheet, wherein said antenna pattern is provided on the adhesion side of the first glass sheet, and wherein a part or the whole of at least a portion of said adhesive layer, which portion is opposite to said antenna pattern, is made of a material with dielectric loss lower than that of said adhesive layer.

9. A glass antenna, comprising:

a glass substrate;

an antenna pattern; and a ground pattern which reflects a radiated wave radiated from said antenna pattern, wherein said ground pattern is provided on one side of said glass substrate, wherein said antenna pattern is buried inside said glass substrate, wherein a part or the whole of at least a portion of said glass sheet, which portion is opposite to said antenna pattern, is made of a material with dielectric loss lower than that of said glass substrate.

10. A glass antenna, comprising:

a glass substrate;

an antenna pattern; and a ground pattern which reflects a radiated wave radiated from said antenna pattern, either or both of said antenna pattern or said ground pattern being buried inside said glass substrate, wherein said antenna pattern and said ground pattern are buried inside said glass substrate oppositely to each other, said antenna pattern and said ground pattern being apart from each other so that a reflection distance with which the radiated radio wave is capable of being reflected is maintained, wherein said glass substrate is a laminated glass sheet which is made of two glass sheets, a first glass sheet and a second glass sheet, stuck together with an adhesive layer interposed therebetween, wherein said antenna pattern is provided on an adhesion side of the first glass sheet, wherein said ground pattern is provided on an adhesion side of the second glass sheet, and wherein a part or the whole of at least a portion of said adhesive layer, which portion is opposite to said antenna pattern, is made of a material with dielectric loss lower than that of said adhesive layer.

11. A glass antenna, comprising:

a glass substrate;

an antenna pattern; and a ground pattern which reflects a radiated wave radiated from said antenna pattern, either or both of said antenna pattern or said ground pattern being buried inside said glass substrate, wherein said antenna pattern and said ground pattern are buried inside said glass substrate oppositely to each other, said antenna pattern and said ground pattern being apart from each other so that a reflection distance with which the radiated radio wave is capable of being reflected is maintained, wherein said glass substrate is a laminated glass sheet which is made of two glass sheets, a first glass sheet and a second glass sheet, stuck together with an adhesive layer interposed therebetween, wherein said antenna pattern is provided on an adhesion side of the first glass sheet, wherein said ground pattern is provided on an adhesion side of the second glass sheet, and wherein a part or the whole of at least a portion of said glass sheets, which portion is opposite to said antenna pattern, is made of a material with dielectric loss lower than that of said glass sheet.

12. A glass antenna manufacturing method, comprising:

forming an antenna pattern on one side of a first glass sheet, and forming a ground pattern on an other side of the first glass sheet, said ground pattern reflecting radiated radio waves of the antenna pattern;

sticking the other side of the first glass sheet and one side of a second glass sheet together with an adhesive layer interposed therebetween.

13. A glass antenna manufacturing method, comprising:

forming an antenna pattern on one side of a first glass sheet, and forming a ground pattern on an other side of the first glass sheet, said ground pattern reflecting radiated radio waves of the antenna pattern;

sticking the one side of the first glass sheet or the other side of the first glass sheet and one side of a second glass sheet together with an adhesive layer interposed therebetween;

removing a part or the whole of at least a portion of the adhesive layer, which portion is opposite to the antenna pattern, and filling the removed portion with a material with dielectric loss lower than that of the adhesive layer.

14. A glass antenna manufacturing method, comprising:

forming an antenna pattern on one side of a first glass sheet, and forming a ground pattern on an other side of the first glass sheet, said ground pattern reflecting radiated radio waves of the antenna pattern;

sticking the one side of the first glass sheet or the other side of the first glass sheet and one side of a second glass sheet together with an adhesive layer interposed therebetween;

removing a part or the whole of at least a portion of the glass sheet, which portion is opposite to the antenna pattern, and filling the removed portion with a material with dielectric loss lower than that of the glass sheet.

15. A glass antenna manufacturing method, comprising:

forming an antenna pattern on one side of a first glass sheet, and forming a ground pattern on one side of a second glass sheet, said ground pattern reflecting radiated radio waves of the antenna pattern;

sticking the other side of the first glass sheet and one side of the second glass sheet together with an adhesive layer interposed therebetween.

16. A glass antenna manufacturing method, comprising:

forming an antenna pattern on one side of a first glass sheet, and forming a ground pattern on one side of a second glass sheet, said ground pattern reflecting radiated radio waves of the antenna pattern;

sticking the one side of the first glass sheet or the other side of the first glass sheet and one side of the second glass sheet together with an adhesive layer interposed therebetween;

removing a part or the whole of at least a portion of the adhesive layer, which portion is opposite to the antenna pattern, and filling the removed portion with a material with dielectric loss lower than that of the adhesive layer.

17. A glass antenna manufacturing method, comprising:

forming an antenna pattern on one side of a first glass sheet, and forming a ground pattern on one side of a second glass sheet, said ground pattern reflecting radiated radio waves of the antenna pattern;

sticking the one side of the first glass sheet or the other side of the first glass sheet and one side of the second glass sheet together with an adhesive layer interposed therebetween;

removing a part or the whole of at least a portion of the glass sheets, which portion is opposite to the antenna pattern, and filling the removed portion with a material with dielectric loss lower than that of the glass sheet.

* * * * *